United States Patent [19]

Oberstrass

[11] Patent Number: 4,611,767

[45] Date of Patent: Sep. 16, 1986

[54] YARN WINDING APPARATUS WITH DOFFING MEANS

[75] Inventor: Detlev Oberstrass, Tönisheide, Fed. Rep. of Germany

[73] Assignee: Barmag Barmer Maschinenfabrik AG, Remscheid, Fed. Rep. of Germany

[21] Appl. No.: 778,413

[22] Filed: Sep. 20, 1985

[30] Foreign Application Priority Data

Sep. 22, 1984 [DE] Fed. Rep. of Germany ..... 3434871

[51] Int. Cl.[4] ..... B65H 54/42; B65H 54/553; B65H 49/26

[52] U.S. Cl. ..... 242/18 DD; 242/129.51

[58] Field of Search ..... 242/18 DD, 129.51, 65, 242/66

[56] References Cited

U.S. PATENT DOCUMENTS

| | | | |
|---|---|---|---|
| 2,989,257 | 6/1961 | Schuler et al. | 242/18 DD |
| 3,131,885 | 5/1964 | Furst et al. | 242/129.51 |
| 3,940,076 | 2/1976 | Kato et al. | 242/18 DD X |
| 3,941,320 | 3/1976 | Strunk | 242/18 DD |
| 4,015,786 | 4/1977 | Slavik et al. | 242/18 DD X |
| 4,138,070 | 2/1979 | Mackie | 242/18 DD X |

FOREIGN PATENT DOCUMENTS

| | | | |
|---|---|---|---|
| 906745 | 9/1962 | United Kingdom | 242/18 DD |
| 951252 | 3/1964 | United Kingdom | 242/18 DD |

*Primary Examiner*—Stanley N. Gilreath

*Attorney, Agent, or Firm*—Bell, Seltzer, Park & Gibson

[57] ABSTRACT

A yarn winding apparatus is disclosed which includes means for facilitating the doffing of relatively large, heavy packages. The apparatus includes a U-shaped package holder having a pair of parallel arms, and a pair of mounting discs are mounted adjacent the free ends of the arms for mounting a bobbin tube therebetween. A package guide member is also mounted to the arms of the holder, with the guide member including a pair of tracks which are adapted to be positioned so as to underlie the ends of the bobbin tube and extend slightly downwardly toward the front of the machine. Control means are also provided for axially separating the mounting discs, to release the ends of the bobbin tube, and so that a full package may be released from the package holder. The package is then adapted to fall onto the tracks of the guide member, and roll forwardly along the tracks to a readily accessible position adjacent the front of the machine.

16 Claims, 4 Drawing Figures

YARN WINDING APPARATUS WITH DOFFING MEANS

The present invention relates to a yarn winding apparatus having means to facilitate the doffing of full packages.

Conventional yarn winding machines include a U-shaped package holder which is mounted to the machine frame so as to pivot about a fixed axis. The holder includes provision for releasably mounting a bobbin tube between the two arms of the holder, and a drive roll is mounted to the machine frame so as to contact the surface of the bobbin tube and impart rotation thereto. The build of the package formed on the tube thus causes the holder to pivot about its mounting axis.

Recently, the development of winding machines has been directed toward larger and heavier full packages for reasons of efficiency, and the size of the full packages renders it difficult for operating personnel to remove them from the winding machine, without auxiliary devices. As a result, there is a need for simplifying and facilitating the doffing of such packages from the machine.

It is accordingly an object of the present invention to simplify and facilitate the doffing operation of large packages, and in addition, to facilitate the transfer of such packages to a receiving and transporting device.

It is another object of the present invention to provide a doffing apparatus for a yarn winding machine which permits the full package to be lifted from its drive roll, braked by any suitable means, and then released from its package holder after it has been stopped, and so that the package is brought to a readily accessible position, or directly to a receiving and/or transporting device for the full packages.

It is still another object of the present invention to provide a package doffing apparatus for a winding machine which is adapted to be automated in substantial portions, or entirely, and wherein the full package may be raised from its drive roll after having reached a predetermined size, with the package holder being brought to an engaged doffing position, and with the package doff then proceeding automatically.

These and other objects and advantages of the present invention are achieved in the embodiment illustrated herein by the provision of a yarn winding apparatus which comprises a package drive roll mounted for rotation about a fixed drive axis, a U-shaped package holder comprising a pair of spaced apart parallel arms defining a winding axis therebetween, and a pair of package mounting discs rotatably mounted to respective ones of the arms of the package holder so as to be adapted to mount a bobbin tube along the winding axis and between the arms. The package holder is mounted for pivotal movement about a pivot axis which is parallel to the drive axis and the winding axis, and such that a bobbin tube mounted between the arms of the holder is adapted to contact and move away from the drive roll as the package builds. A pair of guide tracks are mounted to respective ones of the arms of the package holder, preferably for pivotal movement about an axis parallel to or coincident with the winding axis, and for movement between a winding position, and a doffing position wherein the guide tracks are disposed under the ends of the bobbin tube mounted on the package holder and wherein the tracks are inclined slightly downwardly in a direction extending away from the winding axis. Further, control means are provided for axially separating the mounting discs to release a full package supported therebetween when the guide tracks are in the doffing position.

In the preferred embodiment, the control means includes cam means operatively interconnected between the pair of guide tracks and the pair of mounting discs such that the discs are axially spaced apart a distance to retain a bobbin tube therebetween when the guide tracks are in the winding position, and the discs are axially spaced apart a greater distance to release a bobbin tube supported therebetween when the guide tracks are in the doffing position.

The pair of guide tracks are preferably interconnected by a bracket so as to form a unitary guide member, which can be pivoted between the winding position and the doffing position. When the package has reached its final diameter, the package holder is lifted to a raised position, and rotation of the package is stopped by a suitable braking device as disclosed for example in German OS No. 29 39 628. The guide member may be then rotated to its doffing position, such that the tracks of the guide member are disposed below the extreme ends of the winding tube of the full package. Upon the axial movement of at least one of the two mounting discs, the package is released from the holder with the ends of the tube falling upon the tracks and rolling forwardly to a position at which the package may be easily reached by hand, or by a suitable automated robot. Similarly, it is possible that the tracks of the guide member extend directly to a receiving and transporting device.

Each of the guide tracks may include an up-turned rear end which is adjacent the winding axis, to preclude movement of a released package in the rearward direction. Also, each of the guide tracks preferably includes a stop at the end opposite the up-turned rear end, to preclude movement of the package in the forward direction beyond the stop.

One of the arms of the package holder may be mounted to the machine frame so as to permit it to be pivoted laterally away from the other arm in a known manner, and so as to release the bobbin tube. However, in accordance with the preferred embodiment, the two arms of the holder are fixed with respect to each other and form a substantially rigid U-shaped member. The mounting discs for the bobbin tube are positioned adjacent the free ends of the arms, and are movable in an axial direction relative to the non-movable arms. The direction of this relative movement is controlled according to the function of the discs to either clampingly engage the bobbin tube, or to release the tube.

The axial movement of the mounting discs is preferably controlled by the pivotal movement of the guide member, and such that the release of the tube is only possible when the guide member is rotated to its doffing position and wherein the tracks of the guide member are positioned below the ends of the bobbin tube. As a result, it is insured that the full package is not released from the mounting discs and the package holder prior to the tracks being properly disposed under the ends of the bobbin tube. A particularly suitable embodiment for this automation is characterized in that the pivoting movement of the guide member to its lower rotated position also effects the axial movement of at least one of the mounting discs, so as to release the bobbin tube. Conversely, the pivoting movement of the guide member to its up-turned position effects the axial movement of the mounting discs toward each other for the purpose of clamping the empty bobbin tube.

Some of the objects and advantages of the present invention having been stated, others will appear as the description proceeds, when taken in conjunction with the accompanying drawings, in which FIG. 1 is a schematic side elevation view of a yarn winding apparatus which embodies the features of the present invention;

Figure 1:
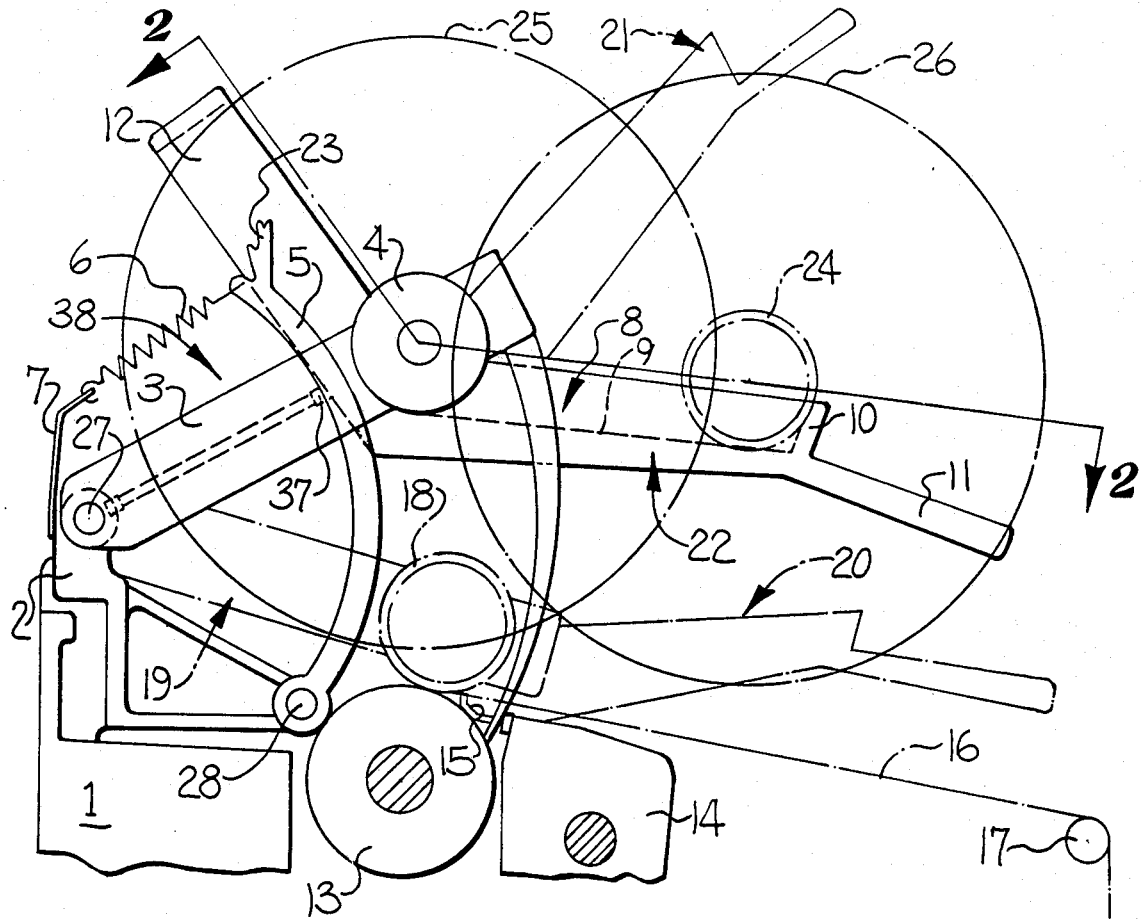

Referring more particularly to the drawings, FIG. 1 schematically illustrates a yarn winding apparatus in accordance with the present invention, and which includes a U-shaped package holder 3 comprising a pair of spaced apart parallel arms. The holder is pivotally supported on the bearing block 2 of the machine frame 1 for pivotal movement about the axis of shaft 27 which extends between the arms. A damping bracket 5 is rotatably mounted to the machine frame 1 by means of the bearing 28, and is adapted to cooperate with a sliding block 37 mounted on an arm of the holder in a known manner. More particularly, a tension spring 6 which is held by a bracket 7, has its free end connected to the bracket head 23, by which the damping bracket 5 is pressed against the slide block 37.

The two arms of the package holder 3 are substantially identical, and form, together with the shaft 27, a rectangular frame which is open at its front side. A pair of package mounting discs 29 are mounted to respective ones of the arms of the package holder, so as to be adapted to mount a bobbin tube 18 along a winding axis which is thereby defined between the arms. The discs 29 are mounted adjacent the free ends of the arms, and on the inwardly facing sides of the arms.

The apparatus further includes a package drive roll 13, and a yarn traversing system 14 which includes a traversing yarn guide 15. The traversing yarn guide 15 reciprocates along the package, and guides the advancing yarn 16, via a deflecting roll 17, to the winding position.

FIG. 1 illustrates in solid lines the package holder 3 in its doffing position 38. The full package 25 is lifted from the drive roll 13, and the package holder 3 is secured in this position by the slide block 37, which is engaged in a recess provided therefor in the damping bracket 5.

Figure 2:
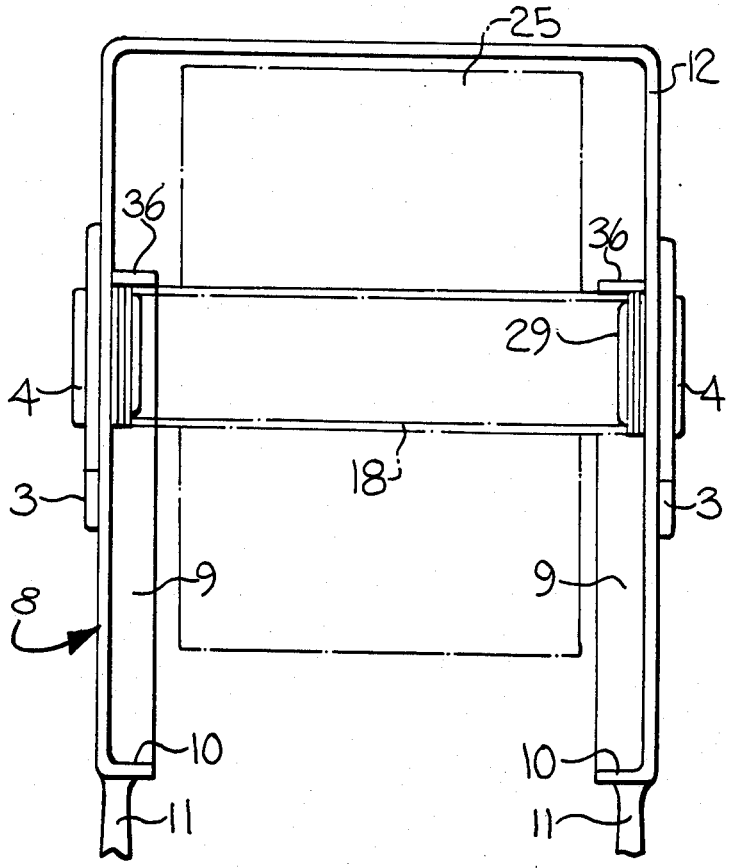
FIG. 2 is a sectional front view taken substantially along the line II—II of FIG. 1.

A guide member 8, which includes a pair of guide tracks 9, is mounted to the package holder 3 for rotation about the winding axis. More particularly, the guide tracks 9 are pivotally mounted to respective ones of the arms of the package holder, and so that the guide member is mounted for pivotal movement between a winding position 20,21, and a doffing position 22. Each of the two tracks 9 includes an up-turned rear end 36 adjacent the winding axis, to preclude movement of a released bobbin tube in a rearward direction. Also, each of the guide tracks includes a stop 10 at the opposite forward end, to preclude movement of a released bobbin in a forward direction beyond the stop. Further, a bracket 12 interconnects the rearward ends of the two tracks, and a handle 11 is positioned at the forward end of each of the tracks. As best seen in FIG. 1, the bracket 12 does not form an extension of the tracks 9, but is angled with respect thereto for reasons of space. Also, the bracket 12 is dimensioned so that a full package, as indicated in dash-dot lines at 25 in FIG. 2, fits within the bracket 12 without touching.

As seen in FIG. 1, the guide member 8 is shown in solid lines in its lower rotated position, i.e., its doffing position 22. In this position, the tracks 9 of the guide member 8 are disposed under the ends of a bobbin tube 18 mounted on the package holder, and the tracks are inclined slightly downwardly in a direction extending away from the winding axis, i.e., in a forward direction which extends toward the operating side of the winding machine. Thus when the mounting discs 29 are axially separated in the manner described below, the winding tube 18 is released and contacts the up-turned rear ends 36, and the full package rolls forwardly to the position 26 and until the ends of the bobbin tube contact the stops 10. Of significance is the fact that the ends of the bobbin tube are released only when the up-turned ends 36 are below them.

The guide member 8 is pivotable to a raised winding position as indicated in dash-dot lines at 20 and 21. The guide member 8 is held in the winding position during the winding operation, and it remains in this position relative to the package holder 3 until the completion of the winding operation. When the winding operation is completed, the package 25 is raised and the package holder 3 is secured by the block 37 in its doffing position 38. The guide member 8 is then lowered from the position 21 to its doffing position 22. To insure trouble-free operation, it is preferred that when an empty bobbin tube is mounted between the discs 29 at the end of the package doff, the guide member 8 is returned to its upper rotated position 21 and secured in this position, and it is subsequently released only after the package holder 3 has again been brought to its doffing position 38.

With respect to the design and construction of the mounting arrangement for the mounting discs 29, it is possible to use a guide member 8 in association with winding systems of known types, and wherein one or both of the arms of the package holder are laterally movable for the release of the bobbin tube by the discs 29. However, it is preferred that the arms of the package holder be rigidly interconnected, and so as to be rotatable about a common axis, i.e. the axis of shaft 27, and with at least one of the mounting discs being axially movable with respect to its associated arm. An advantageous embodiment of a mechanism of this type is illustrated in FIG. 3.

Figure 3:
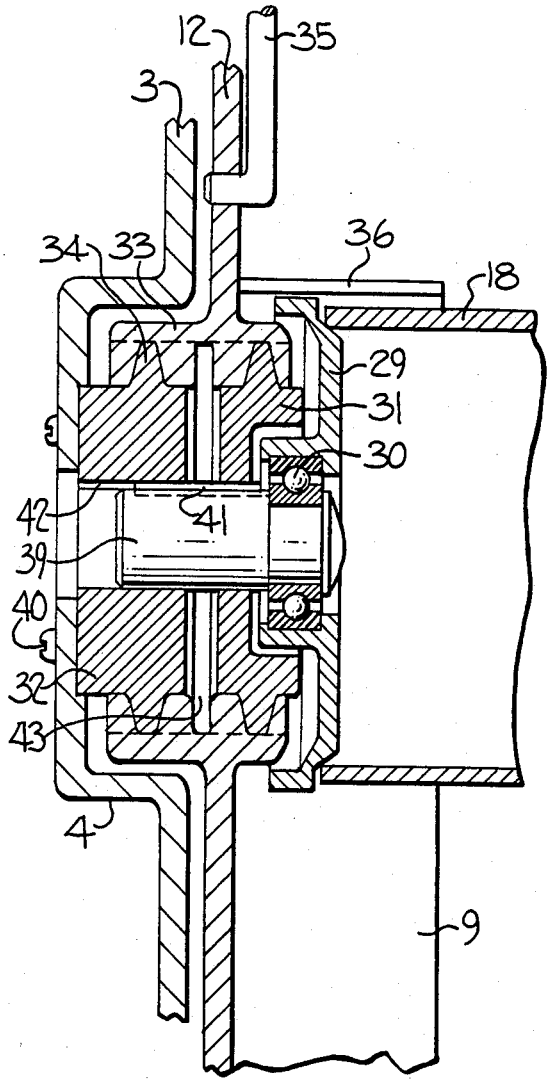
FIG. 3 is a fragmentary sectional view of one side of the package holder and illustrating the structure for mounting the disc for axial movement.

FIG. 3 is a horizontal sectional view of the mounting mechanism for one of the mounting discs 29, taken along the winding axis. The arm of the package holder 3 includes a lateral recess concentric to the winding axis, and which defines a housing 4 which accommodates the mechanism. A thrust plate 32 is mounted in the bottom of the housing, and is connected thereto by bolts indicated at 40. The thrust plate 32 includes an axial bore which is aligned with the winding axis, and which mounts a bearing pin 39. The inner end of the pin 39 mounts a roller bearing 30, which in turn mounts the mounting disc 29. The bearing 30 is mounted between shoulders which prevent its axial movement with respect to the pin 39, and the disc 29 is fixedly mounted on the bearing 30, so that the disc 29 is retained against axial movement with respect to the pin 39. A second thrust plate 31 is mounted to the pin between the first thrust plate 32 and the mounting disc 29. Each of the thrust plates 31 and 32 include a keyway 42, and the pin 39 includes a key 41 which is disposed in the keyways 42 of the thrust plates 31 and 32, such that the thrust plates and pin 39 are non-rotatable with respect to each other. Also, the thrust plate 31 is mounted so as to be held against axial movement with respect to the pin 39, whereas the pin 39 may move axially with respect to the thrust plate 32. As a result, the thrust plate 31 and the mounting disc 29 are movable in the axial direction.

The apparatus of the present invention further includes control means for axially separating the mounting discs 29 to release a bobbin tube 18 supported therebetween, when the guide member 8 is in the doffing position. This control means includes a hub 33 as seen in FIG. 3, which is fixedly connected to the associated track 9. The hub is connected to the thrust plate 31, and also with the thrust plate 32, by means of peripheral guideways, of which at least one is in the form of a helical screw coupling 34. The peripheral guideways or screw couplings permit the hub 33 to rotate, so that the thrust plates 31 and 32 are moved toward or away from each other in the axial direction.

The operation of the mechanism shown in FIG. 3 is as follows. To release the bobbin tube 18, the mounting disc 29 should be moved to the left, when the guide member 8 is pivoted to its lower position 22. In other words, the hub 33 is rotated counter clockwise when viewed from the right side of FIG. 3. Accordingly, the pitch of the thread in the thrust plate 32 should extend in a direction such that the hub 33 moves to the left, i.e., the pitch should be left handed. The second thrust plate 31, which is axially fixed with respect to the mounting disc 29, has a right hand thread. This arrangement serves to double the lateral displacement of the disc 29, since both of the plates 31 and 32 move with respect to the hub, and the plate 32 is fixed to the arm of the holder 3. An annular groove 43 separates the two opposite threads in the hub 33 from each other.

The screw couplings may be composed of cooperating threads which engage each other in the normal manner. However, it is also possible to provide one part with a thread groove, and the other part with pins which engage with the thread groove. To reduce friction, the pins may be equipped with smoothly running, cylindrical rollers. In a simple embodiment, each thrust plate may be provided with a single guide pin. However, several, for example three, guide pins may be provided for each thrust plate 31,32, which would extend with their axes in a common plane which is perpendicular to the winding axis, and with the grooves correspondingly shaped. An advantage of such an embodiment is the fact that when the release of the mounting disc is coupled with the rotation of the guide member 8 to its working position 22, the mounting disc 29 may be released only at the final rotation phase by appropriate design of the grooves. Thus for example, the grooves may include a first rotational phase which extends in a plane perpendicular to the winding axis, and with the groove including an appropriate pitch for producing the desired axial movement during a second rotation phase. A spring lever 35 may be provided which serves to produce an initial stress for holding the guide member 8 in its upper position 21. Also, a suitable locking mechanism (not shown) may be provided which engages and retains the guide member 8 in each of its two positions 21 and 22.

Figure 4:
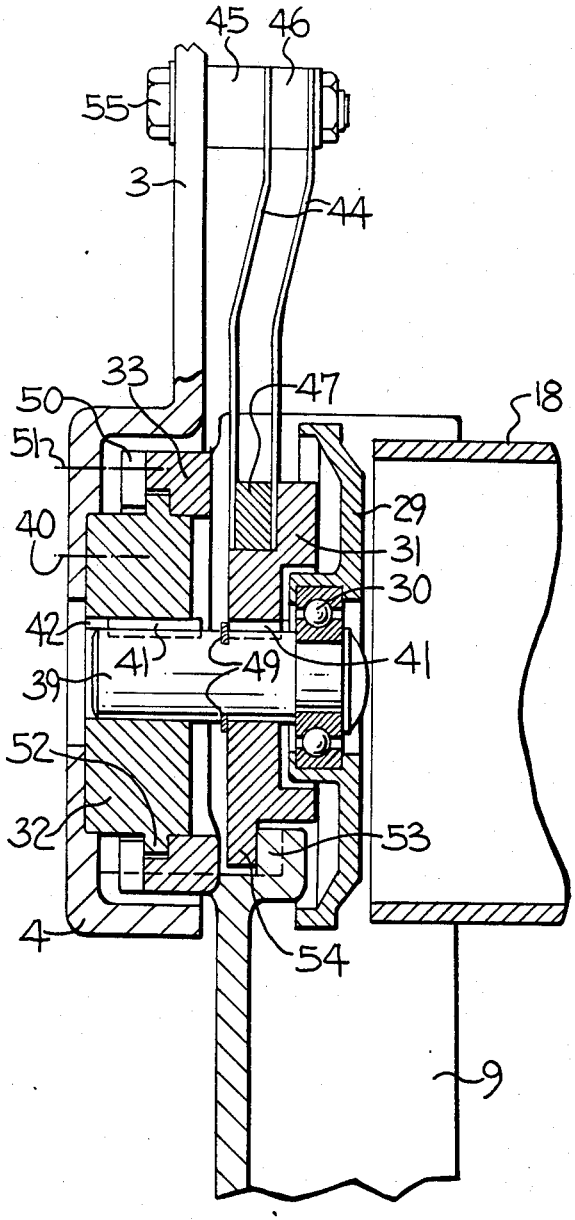
FIG. 4 is a view similar to FIG. 3 but illustrating a further embodiment of the structure for mounting the disc for axial movement.

FIG. 4 illustrates another embodiment for axially moving at least one of the mounting discs 29. In this embodiment, the stationary thrust plate 32 is mounted by means of bolts 40 to the housing 4 of the package holder 3. A bearing pin 39 is mounted in the central bore of the plate 32, for limited axial displacement. Also, the pin 39 mounts on its right end portion the bearing 30, which is fixed thereto so as to preclude relative movement in the axial direction. The second thrust plate 31 is mounted on the bearing pin 39, and is held against rotation with respect to the pin by means of the key 41, and is held against axial movement by means of a snap ring 49 and the bearing 30. Thus the thrust plate 31 and pin 39 are adapted to move together in the axial direction. As will be apparent, the mounting disc 29 moves with the thrust plate 31 and pin 39 during axial movement thereof. Also, a parallel spring 44 is mounted so as to bias the mounting disc 29 in a direction toward the bobbin tube 18.

Each of the two thrust plates 31 and 32 is held against rotation with respect to the pin 39 by the key 41 which engages the keyways 42, and the snap ring 49 mounted between the two thrust plates serves to axially secure the thrust plate 31 on the pin 39. It should be noted however, that the snap ring represents only one method for axially securing the thrust plate 31 to the pin 39, and other suitable means may be provided for this same purpose.

The thrust plate 31 is connected to the free end of the parallel spring 44, and the other end of the spring 44 is mounted on the package holder 3 by means of a spring holder 45 and bolt 55. The parallel arrangement of the two arms of the spring is provided by means of a spacer 46 and mounting piece 47. As noted above, the parallel spring is biased to move the mounting disc 29 against and into the bobbin tube 18.

A peripheral guideway connects the rotatable hub 33 with each of the thrust plates 31 and 32. The guideway is formed between the stationary plate 32 and the hub by means of a collar 52 provided on the plate 32 which engages a circular groove in the hub 33. The groove is formed by a cover 50, which is secured to the hub by bolts 51. The groove and collar 52 secure the hub 33 axially in position relative to the thrust plate 32, and permit only relative rotational movement.

The rotary connection between the hub 33 and the thrust plate 31 is formed by a curved thread portion 53 formed on the hub, which engages a projection 54 formed on the thrust plate 31. The hub 33 is fixedly connected to its associated guide track 9, and when the guide member 8 is lowered to its lower or doffing position, the hub 33 is turned counter clockwise, when viewed from the right side of FIG. 4. As a result, the thrust plate 31, together with the pin 39, bearing 30, and disc 29, are moved to the left, and the winding tube 18 is released. When the guide member 8 is rotated to its upper position, the hub 33 is moved in the opposite rotary direction. The thrust plate 31, together with the mounting disc 29, is then moved to the right by the action of the spring 44, to effect clamping of the winding tube 18.

In the drawings and specification, there has been set forth a preferred embodiment of the invention, and although specific terms are employed, they are used in a generic and descriptive sense only and not for purposes of limitation.

That which is claimed:

1. A yarn winding apparatus for winding a yarn onto a rotating bobbin tube, and comprising a package drive roll mounted for rotation about a fixed drive axis, a U-shaped package holder comprising a pair of spaced apart parallel arms defining a winding axis therebetween, a pair of package mounting discs, means rotatably mounting said discs to respective ones of said arms of said package holder so as to be adapted to mount a bobbin tube along said winding axis and between said arms, means mounting said package holder for pivotal movement about a pivot axis which is parallel to said drive axis and said winding axis, and such that a bobbin tube mounted between the arms of said holder is adapted to contact and move away from said drive roll as the package builds, a pair of guide tracks mounted to respective ones of said arms of said package holder for pivotal movement about an axis parallel to or coincident with said winding axis, and for movement between a winding position, and a doffing position wherein the guide tracks are disposed under the ends of a bobbin tube mounted on said package holder and said tracks are inclined slightly downwardly in a direction extending away from said winding axis, and control means for axially separating said mounting discs to release a full package supported therebetween, and such that said guide tracks are adapted to be positioned in said doffing position and the full package released to fall onto said guide tracks and roll to a desired position.

2. The yarn winding apparatus as defined in claim 1 wherein said means rotatably mounting said discs to respective ones of said arms of said package holder comprises a pin mounted to at least one of said arms and extending coaxially with respect to said winding axis, and with the associated disc being coaxially mounted to said pin.

3. The yarn winding apparatus as defined in claim 2 wherein said control means comprises means mounting said pin to said one arm and mounting said associated disc to said pin to permit axial movement of said disc relative to said one arm, and means for selectively moving said associated disc in the axial direction.

4. The yarn winding apparatus as defined in claim 3 wherein said means for selectively moving said associated disc in the axial direction includes cam means disposed between the associated track and said associated disc for axially moving said associated disc upon pivotal movement of said track.

5. The yarn winding apparatus as defined in claim 1 wherein said control means includes cam means operatively interconnected between said pair of guide tracks and said pair of mounting discs such that said discs are axially spaced apart a distance to retain a bobbin tube therebetween when said guide tracks are in said winding position, and said discs are axially spaced apart a greater distance to release a bobbin tube supported therebetween when said guide tracks are in said doffing position.

6. The yarn winding apparatus as defined in claim 5 wherein each of said guide tracks includes an upturned rear end adjacent said winding axis to preclude movement of a released bobbin tube in a rearward direction.

7. The yarn winding apparatus as defined in claim 6 wherein each of said guide tracks includes a stop at the end opposite said up-turned rear end, to preclude movement of a released bobbin in a forward direction beyond said stop.

8. A yarn winding apparatus as defined in claim 7 wherein a bracket fixedly interconnects said pair of said guide tracks.

9. The yarn winding apparatus as defined in claim 5 wherein said means rotatably mounting said discs to respective ones of said arms of said package holder comprises a pin mounted to at least one of said arms and extending coaxially with respect to said winding axis, with said pin being axially movable for a limited distance along said winding axis, means mounting said one disc coaxially about said pin and so as to be axially fixed with respect to said pin, and wherein said cam means is disposed between the associated track and said pin for axially moving said pin and said one disc upon pivotal movement of said guide tracks.

10. The yarn winding apparatus as defined in claim 9 wherein said pin is mounted to the associated arm for non-rotation about said winding axis, and said one disc is rotatably mounted about said pin.

11. The yarn winding apparatus as defined in claim 10 wherein said cam means comprises a thrust plate mounted coaxially about said pin for non-rotation about said winding axis, means fixing the axial location of said thrust plate with respect to said pin, and cooperating cam surfaces disposed between said thrust plate and said associated track.

12. The yarn winding apparatus as defined in claim 11 wherein said cam means further comprises spring biasing means for biasing said one disc in an axial direction toward the other disc.

13. A yarn winding apparatus for winding a yarn onto a rotating bobbin tube, and comprising a package drive roll mounted for rotation about a fixed drive axis, a U-shaped package holder comprising a pair of spaced apart parallel arms defining a winding axis therebetween, a pair of package mounting discs, means rotatably mounting said discs to respective ones of said arms of said package holder so as to be adapted to mount a bobbin tube along said winding axis and between said arms, means mounting said package holder for pivotal movement about a pivot axis which is parallel to said drive axis and said winding axis, and such that a bobbin tube mounted between the arms of said holder is adapted to contact and move away from said drive roll as the package builds, a pair of guide tracks mounted to respective ones of said arms of said package holder, with said guide tracks being adapted to be disposed under the ends of a full package mounted on said package holder and with said tracks being inclined slightly downwardly in a direction extending away from said winding axis, and control means for axially separating said mounting discs to release a full package supported therebetween, and such that the full package is adapted to fall onto said guide tracks and roll to a desired position.

14. The yarn winding apparatus as defined in claim 13 wherein said control means includes hub means rotatably mounted with respect to said arm and operatively interconnecting said mounting means of at least one of said discs and the associated arm, and such that rotation of said hub means results in axial movement of said at least one disc.

15. The yarn winding apparatus as defined in claim 14 wherein said hub means includes a rotary interconnection with each of said mounting means and said associated arm, and wherein at least one of said rotary interconnections includes a curved screw thread portion.

16. The yarn winding apparatus as defined in claim 15 wherein said hub means is connected to the associated track, and wherein said pair of tracks are interconnected and are pivotally mounted about an axis coincident with said winding axis.

* * * * *